US010992066B2

(12) United States Patent
Kolitsidas et al.

(10) Patent No.: US 10,992,066 B2
(45) Date of Patent: Apr. 27, 2021

(54) BROADBAND ANTENNA

(71) Applicant: Telefonaktiebolaget LM Ericsson (publ), Stockholm (SE)

(72) Inventors: Christos Kolitsidas, Stockholm (SE); Stefan Engström, Värmdö (SE); Lars Jonsson, Vällingby (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 0 days.

(21) Appl. No.: 16/612,765

(22) PCT Filed: May 12, 2017

(86) PCT No.: PCT/SE2017/050482
§ 371 (c)(1),
(2) Date: Nov. 12, 2019

(87) PCT Pub. No.: WO2018/208195
PCT Pub. Date: Nov. 15, 2018

(65) Prior Publication Data

US 2020/0169009 A1 May 28, 2020

(51) Int. Cl.
*H01Q 21/00* (2006.01)
*H01Q 21/30* (2006.01)
(Continued)

(52) U.S. Cl.
CPC ..... *H01Q 21/30* (2013.01); *H01Q 5/48* (2015.01); *H01Q 9/285* (2013.01); *H01Q 21/00* (2013.01); *H01Q 21/062* (2013.01)

(58) Field of Classification Search
CPC ..... H01Q 21/30; H01Q 5/48; H01Q 9/285; H01Q 21/24; H01Q 1/246; H01Q 9/26;
(Continued)

(56) References Cited

U.S. PATENT DOCUMENTS 8,325,093 B2 * 12/2012 Holland ..... H01Q 9/285 343/700 MS
9,000,996 B2 * 4/2015 Holland ..... H01Q 13/085 343/795
(Continued)

FOREIGN PATENT DOCUMENTS

CN 103545617 A 1/2014
WO WO-2018208196 A1 * 11/2018 ..... H01Q 13/085

OTHER PUBLICATIONS

Bayraktar et al., "Miniature Meander-Line Dipole Antenna Arrays, Designed via an Orthogonal-Array-Initialized Hybrid Particle-Swarm Optimizer", IEEE Antennas and Propagation Magazine, vol. 53, No. 3, Jun. 2011, pp. 42-59.
(Continued)

*Primary Examiner* — Vibol Tan
(74) *Attorney, Agent, or Firm* — NDWE LLP

(57) ABSTRACT

A single polarized radiator operating within a frequency range, the radiator comprising multiple active dipoles configured to be arranged a predetermined distance from a ground plane. Each active dipole comprising a first active element having first electrical characteristics and a second active element having second electrical characteristics, which first and second active elements are equal in length and provided with a respective feeding point. In each active dipole, first electrical characteristics differs from second electrical characteristics, the length of each active element is selected based on an upper frequency of the frequency range, and the first active element and/or the second active element of each active dipole is/are configured to be capacitively coupled to an active element of an adjacent active dipole.

22 Claims, 7 Drawing Sheets

(51) Int. Cl.
*H01Q 5/48* (2015.01)
*H01Q 9/28* (2006.01)
*H01Q 21/06* (2006.01)

(58) Field of Classification Search
CPC ..... H01Q 21/062; H01Q 5/25; H01Q 9/065; H01Q 21/0025; H01Q 21/061; H01Q 21/065
See application file for complete search history.

(56) References Cited

U.S. PATENT DOCUMENTS 9,190,727 B1 * 11/2015 Urcia ..... H01O 5/0072
10,008,779 B2 * 6/2018 Boryssenko ..... H01Q 9/28
10,741,914 B2 * 8/2020 Vouvakis ..... H01Q 5/48

OTHER PUBLICATIONS

Bhattacharyya, Arun K., "Active Element Pattern Symmetry for Asymmetrical Element Arrays", IEEE Antennas and Wireless Propagation Letters, vol. 6, 2007, pp. 275-278.
Huang et al., "Ground-Enhanced Ultrawideband Single-Polarized Tightly Coupled Dipole Array", 2015 IEEE Advanced Information Technology, Electronic and Automation Control Conference (IAEAC), IEEE, 2015, pp. 1034-1037.
International Preliminary Report on Patentability, PCT App. No. PCT/SE2017/050482, dated Nov. 21, 2019, 13 pages.
International Search Report and Written Opinion, PCT App. No. PCT/SE2017/050482, dated Jan. 23, 2018, 16 pages.
Jones et al., "A New Approach to Broadband Array Design Using Tightly Coupled Elements", IEEE Military Communications Conference, 2007, pp. 1-7.
Kolitsidas et al., "A Study of Partial Resonance Control for Edge Elements in a Finite Array", Progress in Electromagnetics Research Symposium Proceedings, Stockholm, Sweden, Aug. 12-15, 2013, pp. 253-256.
Kolitsidas et al., "Exploiting asymmetry in a capacitively loaded strongly coupled dipole array", 2014 Loughborough Antennas and Propagation Conference (LAPC), IEEE, Nov. 10, 2014, pp. 723-726.
Lee et al., "A 3.37:1 Bandwidth and Low-profile Tightly Coupled Array Antenna", 2016 International Symposium on Antennas and Propagation (ISAP), IEICE, 2016, pp. 696-697.
Munk Ben A., "Finite Antenna Arrays and FSS", IEEE Press, Wiley Interscience, 2003, 383 pages.
Neto et al., "Scanning Performances of Wideband Connected Arrays in the Presence of a Backing Reflector", IEEE Transactions on Antennas and Propagation vol. 57, No. 10, Oct. 2009, pp. 3092-3102.
Shin et al., "A Parameter Study of Stripline-Fed Vivaldi Notch-Antenna Arrays", IEEE Transactions on Antennas and Propagation, vol. 47, No. 5, May 1999, pp. 879-886.
Steyskal Hans P., On the Merit of Asymmetric Phased Array Elements, IEEE Transactions on Antennas and Propagation, Vo. 61, No. 7, Jul. 2013, pp. 3519-3524.
Wheeler Harold A., "Simple Relations Derived from a Phased-Array Antenna Made of an Infinite Current Sheet", IEEE Transactions on Antennas and Propagation, vol. 13, Issue: 4, Jul. 1965, 506-514.
First Office Action, CN App. No. 201780090700.6, dated Sep. 1, 2020, 15 pages (7 pages of English Translation and 8 pages of Original Document).
Communication pursuant to Article 94(3) EPC for EP Application No. 17724953.9, dated Nov. 5, 2020, 6 pages.
Examination Report, IN App. No. 201917042518, dated Jan. 28, 2021, 6 pages.

* cited by examiner

BROADBAND ANTENNA

CROSS-REFERENCE TO RELATED APPLICATIONS

This application is a National stage of International Application No. PCT/SE2017/050482, filed May 12, 2017, which is hereby incorporated by reference.

TECHNICAL FIELD

The present disclosure relates to the field of wireless communication. In particular, it relates to broadband antennas comprising asymmetric dipoles in strongly coupled dipole arrays.

BACKGROUND

Nodes in a wireless communication network require antennas for communication between the network and user equipment, UE, and the number of antennas varies depending on number of frequencies used, type of antenna used and how space diversity is implemented. The typical number of antennas per site is nine with three per sector. Current typical antennas are narrowband and divided into two categories, low band and mid/high band antennas. Low band covers 700-900 MHz frequency range while mid/high band covers 1700-2600 MHz. Operators are often renting site space for antennas from building landlords and tower owners, and the number of antennas, antenna size and weight are factors that determines the rental cost. More and bigger and heavier antennas results in higher rent.

One current solution to reduce number of antennas on a site is to combine low and mid/high band antennas into one antenna, known as multi band antenna. This method has drawbacks since the products become quite expensive and complicated. Since many frequency bands will be placed in same antenna this requires a lot of cabling and phase shifters, which are used for tilt. The material together with complicated building practice in order to achieve good performance results in an expensive product.

Dipole antennas are primarily used in narrowband technology in wireless communication systems. The dipoles are separated from each other to ensure that interaction between the dipoles is minimal, and each dipole array and polarization is interconnected to a common input/output port. Furthermore, each dipole is designed to cover a specific frequency band or a few bands close to each other, and a phase shifter is normally implemented per dipole to achieve vertical tilt for that dipole array. Electrical tilt is realized with an external box called Remote Electrical Tilt, RET. Realizing several frequency bands in a dipole antenna configuration requires several dipole arrays in the same antenna aperture.

An illustrative schematic of a dual polarized dual band dipole antenna 10 with phase shifters 11 operating at two different frequencies (denoted A and B) can be seen in FIG. 1. Two dual polarized antenna elements 12 are provided for each frequency, and are connected to antenna ports $\mathbf{13}_A$ and $\mathbf{13}_B$. The number of antenna elements will differ from antenna to antenna depending on antenna characteristics.

Narrowband antennas such as described above also cause an additional challenge if wideband radios are used. This results in additional duplexers creating more site cost and power consumption increases.

Communications are currently at a premium and an exponential growth in supported services is expected over the next few years. Next generation base stations are envisioned to be able to support all wireless commercial protocols. This requires operation over a wide frequency range.

Furthermore, it is expected to offer advanced beam forming capabilities, like dedicated user beams. It is the path towards implementing an Advanced Antenna System, AAS, for commercial applications. This has generated a strong research interest for commercial wide-band wide-scan angle antenna arrays able to fulfill future base station applications.

Three main technologies stand out as prime candidates for wide-band antenna arrays. The tapered slot or Vivaldi arrays ("A parameter study of stripline-fed vivaldi notch-antenna arrays" by J. Shin and D. H. Schaubert in IEEE Transactions on Antennas and Propagation, vol. 47, no 5, pp. 879-886, May 1999), the Wheeler's concept of the infinite current sheet array and its implementations ("Simple relations derived from a phased-array antenna made of an infinite current sheet" by H. Wheeler, IEEE Transactions on Antennas and Propagation, vol. 13, no. 4, pp. 506-514, July 1965), and the fragmented array ("A new approach to broadband array design using tightly coupled elements", by M. Jones and J. Rawnick in MILCOM 2007—IEEE Military Communications Conference, October 2007, pp. 1-7).

The major problem with current wideband solutions based on Vivaldi technology is the size. The antenna elements are quite large resulting in a much thicker antenna than the traditional dipole based antenna.

The latter two have similar way of operation and mainly differ on the design procedure. Two main implementations stem from the current sheet array concept: the tightly coupled dipoles (Finite Antenna Arrays and FSS by B. Munk—IEEE. Wiley, 2003), and the connected dipoles/slots ("Scanning performances of wideband connected arrays in the presence of a backing reflector" by A. Neto, D. Cavallo, G. Gerini, and G. Toso, IEEE Transactions on Antennas and Propagation, vol. 57, no. 10, pp. 3092-3102, October 2009.).

These implementations can provide wide-band performance with moderate scanning abilities that also keeps a low visible profile. Such antenna arrays constitute a viable candidate for future base stations where it is required wide-band wide-scan angle performance, low profile and also the possibility to conform at surfaces.

Properties of non-symmetric (asymmetric) dipoles have been studied in articles. One with the title: "On the merit of asymmetric phased array elements," by H. Steyskal, published in IEEE Transactions on Antennas and Propagation, vol. 61, no. 7, pp. 3519-3524, July 2013, and another with the title: "Active element pattern symmetry for asymmetrical element arrays," by A. K. Bhattacharyya, published in 2007 IEEE Antennas and Propagation Society International Symposium, June 2007, pp. 5953-5956.

SUMMARY

An object of the present disclosure is to provide an antenna which seeks to mitigate, alleviate, or eliminate one or more of the above-identified deficiencies in the art and disadvantages singly or in any combination.

This object is obtained by a single polarized radiator operating within a frequency range, the radiator comprising multiple active dipoles configured to be arranged a predetermined distance from a ground plane. Each active dipole comprising a first active element having first electrical characteristics and a second active element having second electrical characteristics. The first and second active elements are equal in length and are provided with a respective feeding point. In each active dipole, first electrical characteristics differs from second electrical characteristics, the length of each active element is selected based on an upper frequency of the frequency range, and the first active element and/or the second active element of each active dipole is/are configured to be capacitively coupled to an active element of an adjacent active dipole.

An advantage with the single polarized radiator is a more compact solution than the prior art wideband solutions. A further advantage is that the scanning performance, as well as the flexibility to select operating frequency range, is improved compared to prior art solutions.

According to an aspect, the electrical characteristics of the multiple active dipoles are the same.

An advantage with having the same electrical characteristics for all active dipoles in a radiator is a less expensive manufacturing process.

According to an aspect, the electrical characteristics of each of the multiple active dipoles are unique.

An advantage with having unique electrical characteristics for each active dipole in a radiator is a higher degree of freedom to design the radiator to achieve optimal radiator characteristics.

According to an aspect, the single polarized radiator further comprises a first edge section and a second edge section, the first edge section is capacitively coupled to a first side of the multiple active dipoles and the second edge section is capacitively coupled to a second side, opposite to the first side, of the multiple active dipoles, wherein the edge sections are configured to reduce edge propagating waves.

An advantage with introducing edge sections to the single polarized radiator is that scanning angle performance and side-lobe performance is improved compared to prior art solutions.

According to an aspect, each edge section further comprises multiple edge dipoles and each edge dipole comprises two edge elements being mirror images of each other. Each edge dipole has an edge dipole length, and is arranged the same distance from the ground plane as the active dipoles.

According to an aspect, each edge section further comprises an edge element having an edge profile extending from a forward edge adjacent to the first side of the plurality of the active dipoles to a rear edge connectable to the ground plane, and at least one meandering section is provided in the edge profile.

The above stated object is also obtained by a single polarized radiator operating within a frequency range, and the radiator comprising multiple active dipoles configured to be arranged a predetermined distance from a ground plane. Each active dipole comprising a first active element having first electrical characteristics and a second active element having second electrical characteristics, and the first and second active elements are equal in length and provided with a respective feeding point. The length of each active element is selected based on an upper frequency of the frequency range, and the first active element and/or the second active element of each active dipole is/are configured to be capacitively coupled to an active element of an adjacent active dipole. The single polarized radiator further comprises a first edge section and a second edge section, the first edge section is capacitively coupled to a first side of the plurality of active dipoles and the second edge section is capacitively coupled to a second side, opposite to the first side, of the plurality of active dipoles, wherein the edge sections are configured to reduce edge propagating waves.

An advantage with the single polarized radiator is that scanning angle performance and side-lobe performance is improved compared to prior art solutions.

According to an aspect, each edge section further comprises multiple edge dipoles and each edge dipole comprises two edge elements being mirror images of each other. Each edge dipole has an edge dipole length, and is arranged the same distance from the ground plane as the active dipoles.

According to an aspect, each edge section further comprises an edge element having an edge profile extending from a forward edge adjacent to the first side of the plurality of the active dipoles to a rear edge connectable to the ground plane, and at least one meandering section is provided in the edge profile.

According to an aspect, in each active dipole, first electrical characteristics differs from second electrical characteristics.

An advantage is that a more compact than the prior art wideband solutions. According to an aspect, the electrical characteristics of the multiple active dipoles are the same.

An advantage with having the same electrical characteristics for all active dipoles in a radiator is a less expensive manufacturing process.

According to an aspect, the electrical characteristics of each of the multiple active dipoles are unique.

An advantage with having unique electrical characteristics for each active dipole in a radiator is a higher degree of freedom to design the radiator to achieve optimal radiator characteristics.

Further aspects and advantages may be found in the detailed description.

BRIEF DESCRIPTION OF THE DRAWINGS

The foregoing will be apparent from the following more particular description of the example embodiments, as illustrated in the accompanying drawings in which like reference characters refer to the same parts throughout the different views. The drawings are not necessarily to scale, emphasis instead being placed upon illustrating the example embodiments.

DETAILED DESCRIPTION

Figure 1:
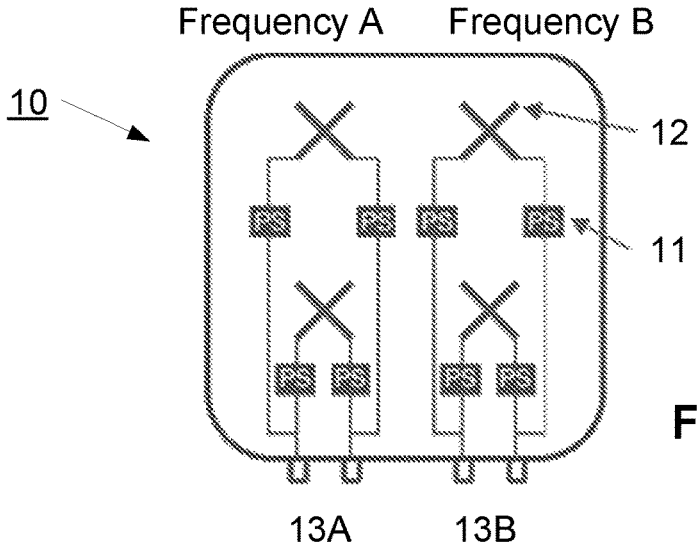
FIG. 1 is a schematic of a dual polarized dual band dipole antenna.

Aspects of the present disclosure will be described more fully hereinafter with reference to the accompanying drawings. The antenna disclosed herein can, however, be realized in many different forms and should not be construed as being limited to the aspects set forth herein. Like numbers in the drawings refer to like elements throughout.

The terminology used herein is for the purpose of describing particular aspects of the disclosure only, and is not intended to limit the invention. As used herein, the singular forms "a", "an" and "the" are intended to include the plural forms as well, unless the context clearly indicates otherwise.

Voltage Standing Wave Ratio, VSWR, is used to illustrate the efficiency of the example embodiments. VSWR is a function of the reflection coefficient, which describes the power reflected from the antenna. If the reflection coefficient is given by Γ, then the VSWR is defined by the following formula:

$$VSWR = \frac{1+|\Gamma|}{1-|\Gamma|}$$

The reflection coefficient is also known as s11 or return loss. See the VSWR table 1 below to see a numerical mapping between reflected power, s11 and VSWR.

| VSWR | Γ (s11) | Reflected Power (%) | Reflected Power (dB) |
|---|---|---|---|
| 1.0 | 0.000 | 0.00 | −Infinity |
| 1.5 | 0.200 | 4.0 | −14.0 |
| 2.0 | 0.333 | 11.1 | −9.55 |
| 2.5 | 0.429 | 18.4 | −7.36 |
| 3.0 | 0.500 | 25.0 | −6.00 |
| 3.5 | 0.556 | 30.9 | −5.10 |
| 4.0 | 0.600 | 36.0 | −4.44 |
| 5.0 | 0.667 | 44.0 | −3.52 |
| 6.0 | 0.714 | 51.0 | −2.92 |
| 7.0 | 0.750 | 56.3 | −2.50 |
| 8.0 | 0.778 | 60.5 | −2.18 |
| 9.0 | 0.800 | 64.0 | −1.94 |
| 10.0 | 0.818 | 66.9 | −1.74 |
| 15.0 | 0.875 | 76.6 | −1.16 |
| 20.0 | 0.905 | 81.9 | −0.87 |
| 50.0 | 0.961 | 92.3 | −0.35 |

VSWR table 1 mapping Voltage Standing Wave Ratio with reflection coefficient s11 and reflected power in % and dB.

Some of the example embodiments presented herein are directed towards single polarized radiators. As part of the development of the example embodiments presented herein, a problem will first be identified and discussed.

This disclosure utilizes asymmetries in a strongly coupled dipole element in order to improve both bandwidth and scanning performance. The asymmetries are introduced on the dipole arms, as described in more detail below, whereas the input lines, the tapered interface and the capacitive patch have been kept intact. Thus, the design procedure starts with an initial strongly coupled dipole design that performs up to a desired standard and in continuance by discretizing only part of the dipole arms, it is possible to optimize the shape of the element and improve bandwidth and scanning performance.

The disclosed method has a faster convergence compared to a fully fragmented design as the solution space (small regions of pixels) is reduced. It should be note, that the degree of freedom is reduced due to the reduced pixelated area. This provides a fast design methodology for wide-band wide-scan angle antenna arrays based on strongly coupled dipoles in combination with fragmented array technique.

Figure 2:
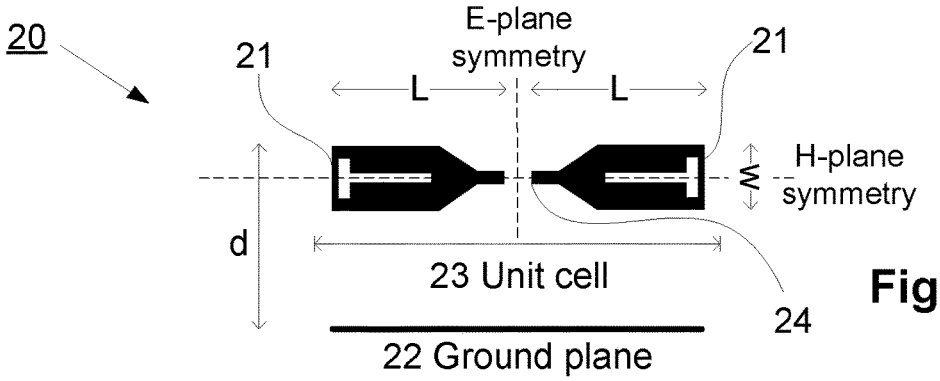
FIG. 2 illustrates a symmetric dipole.

Typically, in order to design pixelated (fragmented) geometry the iterations start from either a full metallic surface and subtract metal or a blank surface and add metallic pixels iterating in order to satisfy the objective function. First a very good initial solution is design and in continuance areas of the design is pixelated in order to achieve faster convergence of the optimization algorithm as every generated geometry requires an electromagnetic solution which is computationally expensive. Thus, the solution space has been reduced. The symmetries of the dipole are depicted in FIG. 2 and the shape is then optimized within pixelated areas (as indicated by dashed white lines on the dipole elements in FIG. 8) using a genetic algorithm without requiring symmetry.

Figure 6:
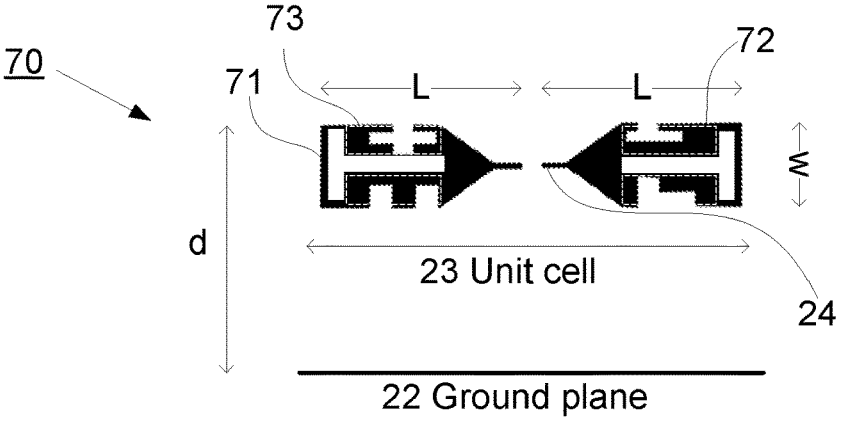
FIG. 6 illustrates an asymmetric dipole.

The objective function used for the optimization procedure is:

$$F = \sum_i \sum_j w_{ij} |\Gamma(\Omega_i, f_j|^2$$

where $\Gamma(\Omega_i, f_j)$ is the active reflection coefficient for scan angle $\Omega_i$, and frequency $f_j$ weighted with a factor $w_{ij}$ that depends on the requirements of the application. This provides flexibility to have an initial design that can easily be re-optimized for different applications. Also, $f_j \in [f_{low}, f_{high}]$ and $\Omega_i \in [\Omega_{low}, \Omega_{high}]$. According to some aspects $w_{ij}=1$, $f_j \in [0.7, 4.2]$ GHz sampled in 20 equispaced points and $\Omega_i \in [0°, 45°]$. The produced asymmetric geometry after optimization procedure is depicted in FIG. 6. In each pixelated area 73 3×6 pixels was used.

FIG. 2 illustrates a symmetric dipole 20 having two identical active elements 21 in relation to a ground plane 22, i.e. the active elements 21 are identical in length "L" and width "w" and have the same electrical characteristics. The dipole 20 is configured to operate within a frequency range having an upper frequency and the length L of each active element 21 is selected based on an upper frequency of the frequency range. However, the width of the antenna element may be selected to obtain a capacitive coupling to adjacent dipole elements as described in more detail in connection with FIGS. 3*a*-3*d*. A predetermined distance d between the ground plane 22 and the active elements 21 is selected based on the upper frequency, and according to some aspects is the predetermined distance d is within the range of 0.25 to 0.5 of the wavelength (i.e. λ/4-λ/2) of the upper frequency. According to some aspects the predetermined distance d is the wavelength of the upper frequency divided by 2.3. Each active element 21 is also provided with a feeding point 24.

Figure 3A:
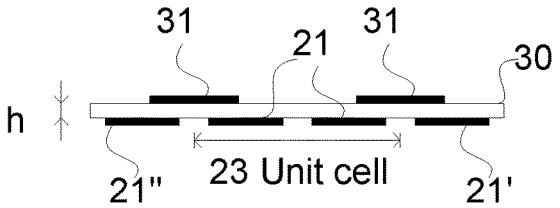
FIGS. 3*a*-3*d* illustrate how strongly coupled dipole elements are achieved.
Figure 3C:
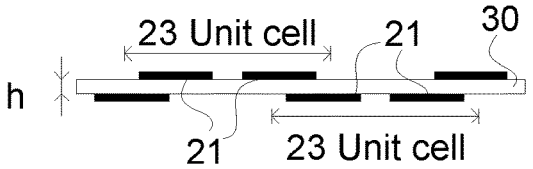
Figure 3B:
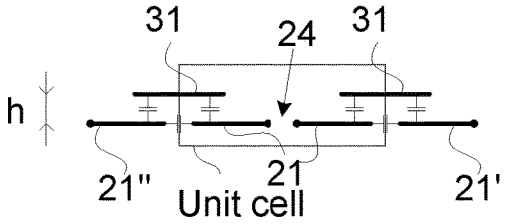
Figure 3D:
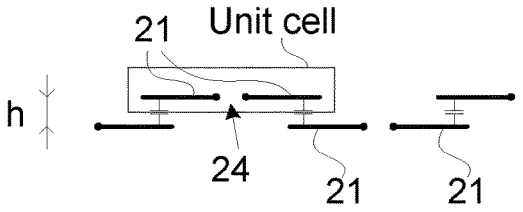

FIGS. 3*a*-3*d* illustrate how strongly coupled dipole elements may be achieved. When an active element in an active dipole is positioned close to an active element of an adjacent active dipole, strongly coupled dipoles are achieved through capacitive coupled active elements. According to some aspects, this is achieved by positioning the active elements of adjacent dipoles close to each other, but the capacitive coupling may not be sufficient to obtain the desired characteristics of the radiator. FIGS. 3*a* and 3*b* illustrate one alternative to obtain strongly coupled dipoles when the dipoles are arranged on the same side of a substrate by creating capacitive coupling between adjacent dipole elements via a coupling element on a reverse side of the substrate, and FIGS. 3*c* and 3*d* illustrate a second alternative to obtain strongly coupled dipoles when the dipoles are arranged on opposite sides of a substrate by arranging adjacent dipole elements to overlap with each other and thereby create capacitive coupling between the adjacent dipole elements.

In the first alternative, dipole elements 21 are arranged on the same side of a substrate 30. A unit cell 23 is indicated with feeding points 24 (only indicated in FIG. 3*b*), and on each side of the indicated unit cell 23, active elements of adjacent active dipoles are indicated by 21' and 21", respectively. At the reverse side of the substrate 30, coupling elements 31 are provided to create a capacitive coupling between one of the active elements 21 on the unit cell dipole and an active element 21' or 21" of the adjacent active dipole. The thickness "h" of the substrate 30 together with the size of the overlapping portion will determine the capacitance between the active element 21, 21' and 21" and the coupling element 31.

In the second alternative, dipole elements 21 are arranged on different sides of the substrate 30. A unit cell 23 on each side is indicated with feeding points 24 (only indicated in FIG. 3*d*). The active elements 21 overlap with each other and the thickness "h" of the substrate and the size of the overlapping portion will determine the capacitance between the active elements on different sides of the substrate 30.

Figure 4:
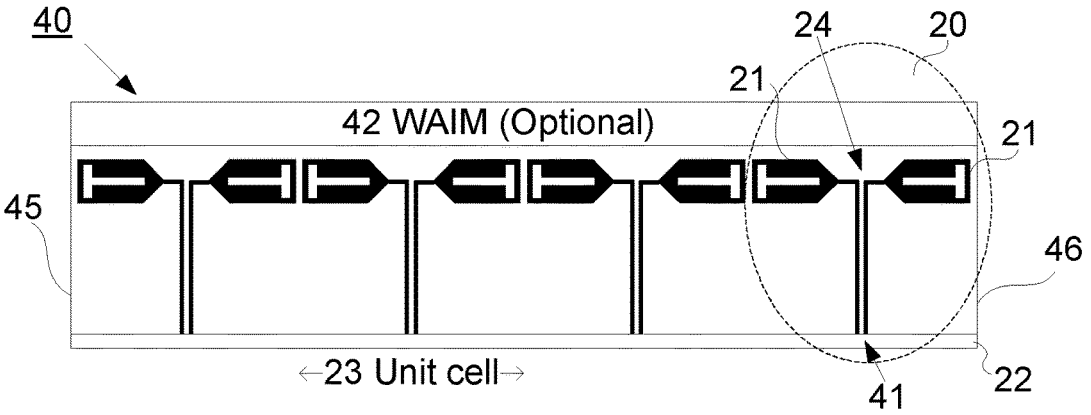
FIG. 4 is a single polarized radiator with strongly coupled symmetric dipole elements.

FIG. 4 is a single polarized radiator 40 with strongly coupled symmetric dipole elements, a dashed circle 20 indicates one active dipole and is described in connection with FIG. 2. In this example four dipoles 20, each forming a unit cell 23 is included in the single polarized radiator 40. The feeding points 24 of the dipoles elements 21 are connected to antenna ports 41. As described in connection with FIGS. 3*a*-3*d*, adjacent dipole elements belonging to different unit cells are capacitively coupled to create strongly coupled dipole elements. An optional lens 42, or commonly named Wide-Angle Impedance Matching, WAIM, is in this example implemented. The single polarized radiator 40 has a first side 45, where the left active dipole only is capacitively coupled to the active dipole on its right side, and a second side 46, where the right active dipole only is capacitively coupled to the active dipole on its left side.

Figure 5:
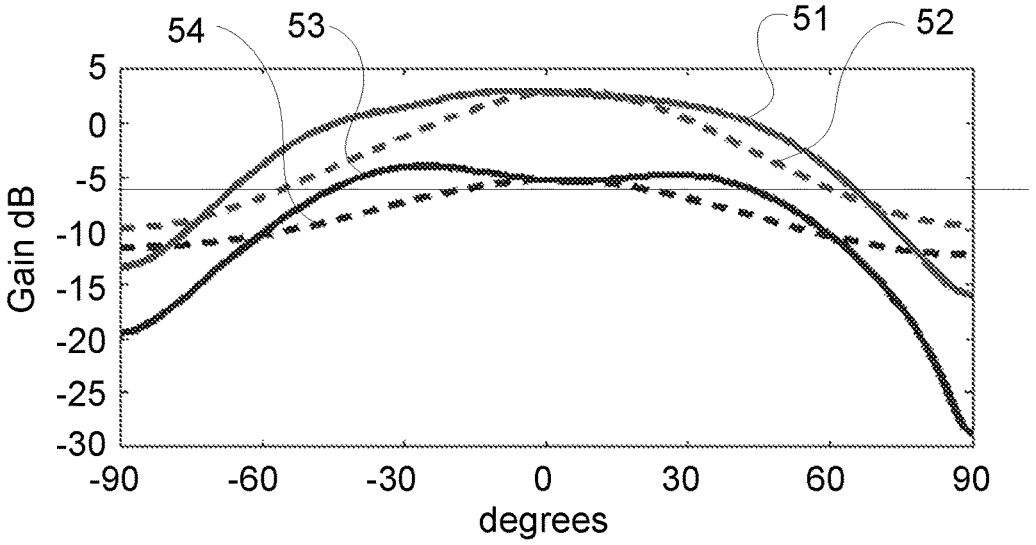
FIG. 5 is a graph illustrating active element pattern for a unit cell of the single polarized radiator in FIG. 4.

FIG. 5 is a graph illustrating active element pattern for a unit cell of the single polarized radiator in FIG. 4 with Gain [dB] as a function of scanning angle [degree] for the unit cell 23. The solid upper curve 51 illustrates the angle characteristics for E-plane at 3 GHz, and the dashed upper curve 52 illustrates the angle characteristics for H-plane at 3 GHz. The solid lower curve 53 illustrates the angle characteristics for E-plane at 2 GHz, and the dashed lower curve 54 illustrates the angle characteristics for H-plane at 2 GHz. The scanning performance for the H-plane is considerable lower than the scanning performance for the E-plane at both frequencies.

FIG. 6 illustrate an asymmetric active dipole 70 configured to be arranged a predetermined distance d from a ground plane 22. The asymmetric dipole 70 comprises a first active element 71 having first electrical characteristics and a second active element 72 having second electrical characteristics, each having a respective feeding point 24. The active elements 71 and 72 are identical in length "L" and the shape of the respective active element is optimized within each pixelated area 73 (as previously described) to create active elements having different shape and thus different electrical characteristics. Thus, the first electrical characteristics differ from second electrical characteristics. The dipole 70 is configured to operate within a frequency range having an upper frequency, and the length L of each active element 71 and 72 is selected based on an upper frequency of the frequency range. According to some aspects the width of each antenna element 71 and 72 may be selected to obtain a capacitive coupling to adjacent dipole elements as described in more detail in connection with FIGS. 3*a*-3*d*.

When multiple active dipoles are arranged in a single polarized radiator, as illustrated in connection with FIG. 7, the first active element and/or the second active element of each active dipole is/are configured to be capacitively coupled to an active element of an adjacent active dipole.

A predetermined distanced between the ground plane 22 and the active elements 71 is selected based on the upper frequency, and according to some aspects is the predetermined distance d is within the range of 0.25 to 0.5 of the wavelength (i.e. $\lambda/4$-$\lambda/2$) of the upper frequency. According to some aspects the predetermined distance d is the wavelength of the upper frequency divided by 2.3.

Figure 7:
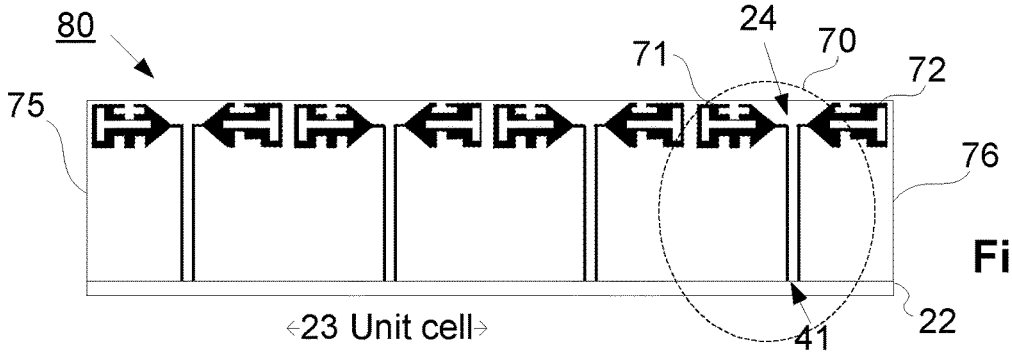
FIG. 7 is a single polarized radiator with strongly coupled asymmetric dipole elements.

FIG. 7 is a single polarized radiator 80 with strongly coupled asymmetric dipole elements 70. In this example four asymmetric active dipoles 70, each forming a unit cell 23 is included in the single polarized radiator 80. The feeding points 24 of the dipoles elements 71 and 72 are connected to antenna ports 41. As described in connection with FIGS. 3*a*-3*d*, adjacent dipole elements belonging to different unit cells are capacitively coupled to create strongly coupled dipole elements. In addition, a WAIM (not shown) may be implemented is in this example. The single polarized radiator 80 has a first side 75, where the left active dipole only is capacitively coupled to the active dipole on its right side, and a second side 76, where the right active dipole only is capacitively coupled to the active dipole on its left side.

As shown in FIG. 7, the electrical characteristics of the multiple active dipoles 70 are the same, i.e. each active dipole is identical but electrical characteristics of the first active element 71 differ from the electrical characteristics of the second active element 72 in each dipole.

According to some aspects, the single polarized radiator comprises active dipoles where electrical characteristics of at least one of the multiple active dipoles are unique.

According to some aspects, the single polarized radiator comprises active dipoles where electrical characteristics of each of the multiple active dipoles are unique. A higher degree of freedom to design a radiator with optimum angular characteristics may be achieved, at the cost of a more complicated manufacturing process.

Figure 8:
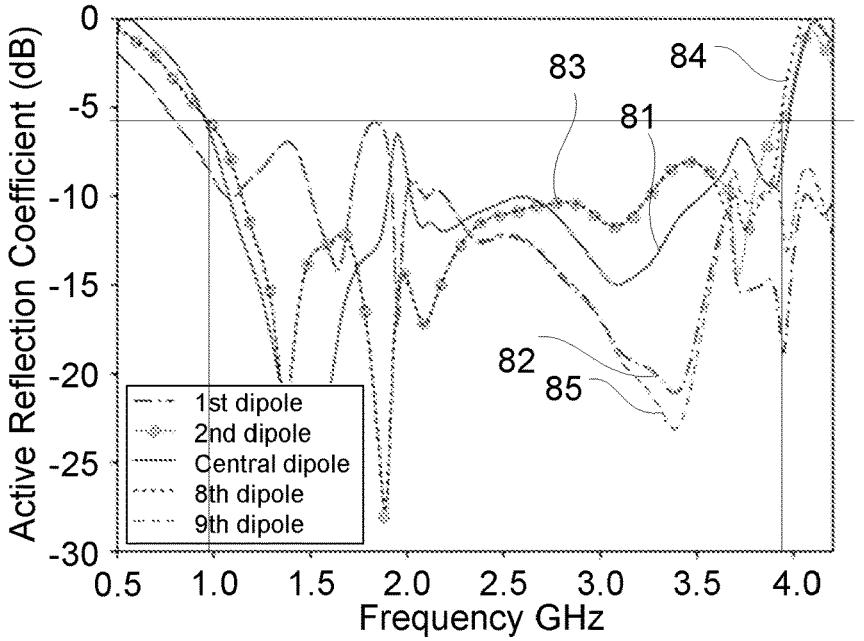
FIG. 8 is a graph illustrating the active reflection coefficient for an embedded single polarized radiator without edge dipoles.

FIG. 8 is a graph illustrating the active reflection coefficient for an embedded single polarized radiator comprising nine asymmetric dipoles without edge dipoles. The frequency range of the radiator is 1-3.9 GHZ, over which the VSWR is less than 3 (i.e. less than −6dB) for all dipoles. The reflection coefficient for the central dipole is denoted 81, the reflection coefficient for the two dipoles to the left side ($1^{st}$ and $2^{nd}$ dipoles of the radiator) are denoted 82 and 83, and the reflection coefficient for the two dipoles to the right side ($8^{th}$ and $9^{th}$ dipoles of the radiator) are denoted 84 and 85.

Figure 9:
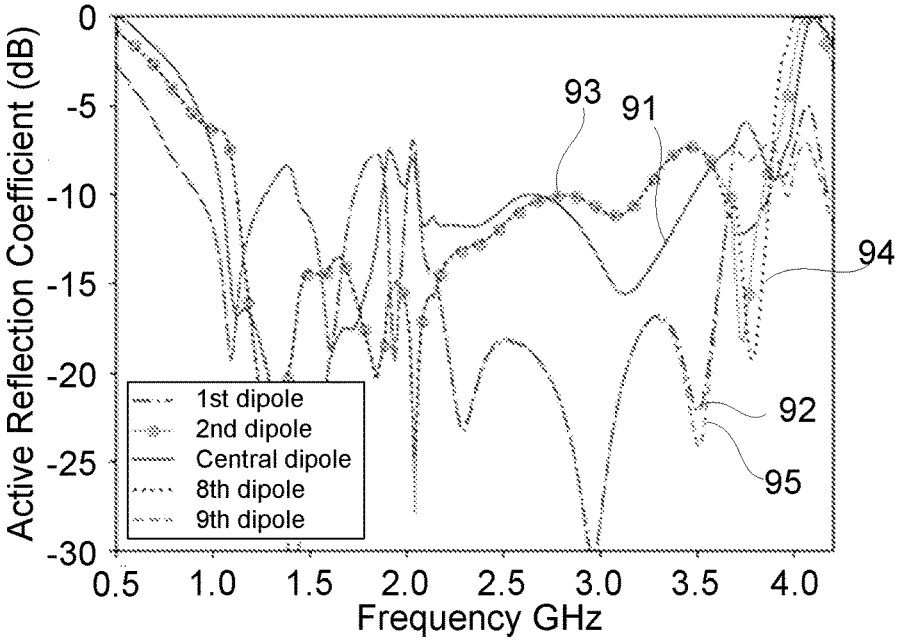
FIG. 9 is a graph illustrating the active reflection coefficient for an embedded single polarized radiator with edge dipoles.

FIG. 9 is a graph illustrating the reflection coefficient for an embedded single polarized radiator comprising nine asymmetric dipoles 70 and edge dipoles as a function of frequency in GHz. The frequency range of the radiator is 1-3.9 GHZ, over which the VSWR is less than 3 (i.e. less than −6dB) for all dipoles. The reflection coefficient for the central dipole is denoted 91, the reflection coefficient for the two dipoles to the left side ($1^{st}$ and $2^{nd}$ dipoles of the radiator) are denoted 92 and 93, and the reflection coefficient for the two dipoles to the right side ($8^{th}$ and $9^{th}$ dipoles of the radiator) are denoted 94 and 95. The introduction of edge dipoles will improve the performance of the $1^{st}$ and $9^{th}$ dipoles (i.e. the dipoles closest to the sides) compared to a radiator not having any edge dipoles as shown in FIG. 8.

According to some aspects, the single polarized radiator described above (with symmetric dipoles or asymmetric dipoles) further comprises a first edge section and a second edge section. The first edge section is capacitively coupled to a first side of the multiple active dipoles and the second edge section is capacitively coupled to a second side, opposite to the first side, of the multiple active dipoles. The edge sections are configured to reduce edge propagating waves.

Figure 10:
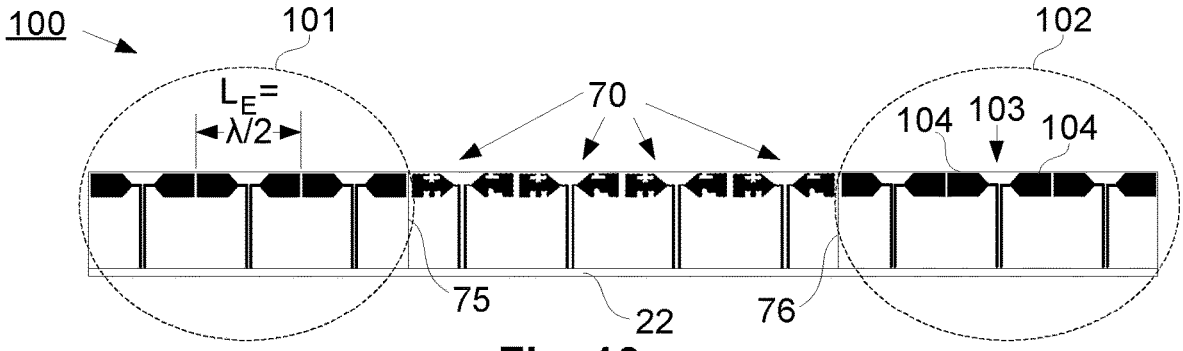
FIG. 10 is a single polarized radiator with edge dipole unit cell of size $\lambda/2$.
Figure 11:
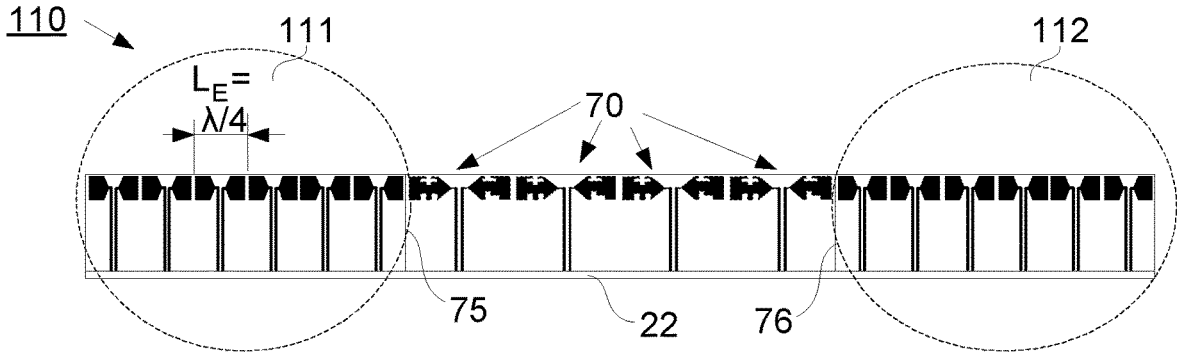
FIG. 11 is a single polarized radiator with edge dipole unit cell of $\lambda/4$.
Figure 12:
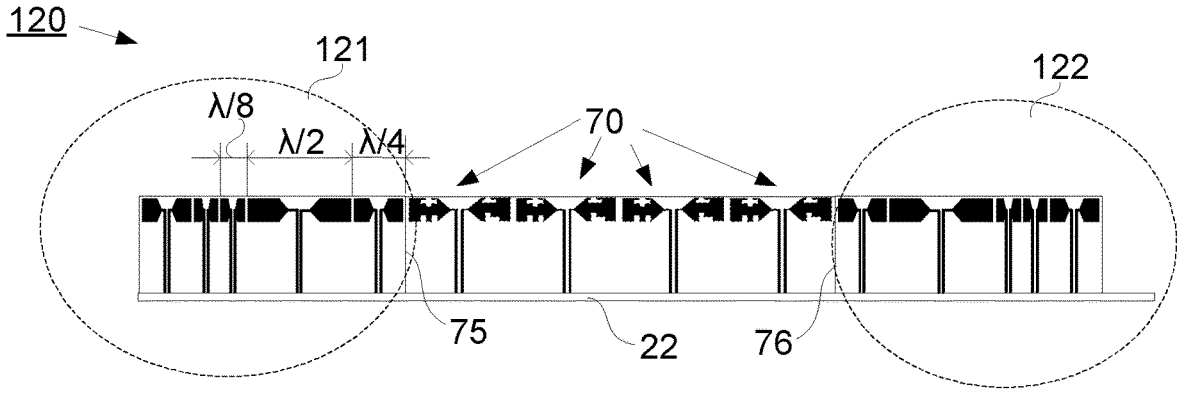
FIG. 12 is a single polarized radiator with edge dipoles having different unit cells.
Figure 15:
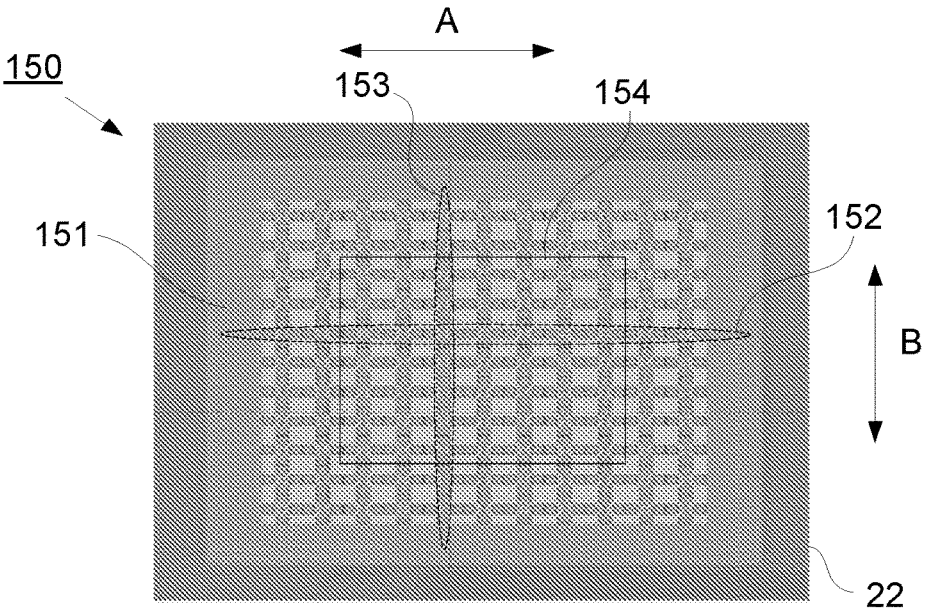
FIG. 15 is a wideband dual polarized strongly coupled dipole element antenna array.
Figure 16:
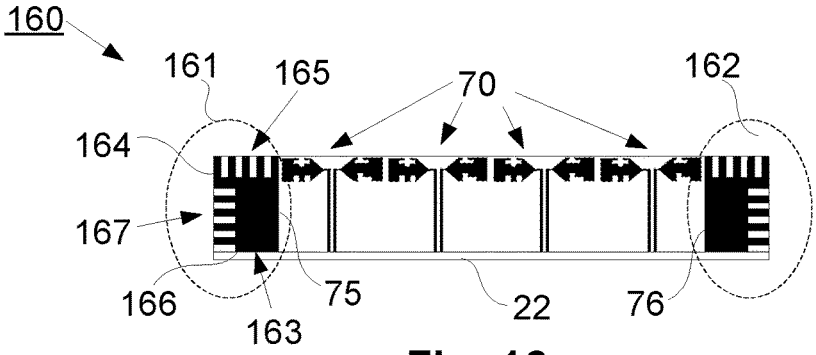
FIG. 16 is a first embodiment of a single polarized radiator with meandering edge elements.

Reduction of edge propagating waves improves the efficiency of the radiator and according to some aspects implemented using edge dipoles 103, as disclosed in connection with FIGS. 10-12, or using an edge element with a meandering section, as disclosed in connection with FIGS. 15 and 16. Edge propagating waves decreases performance such as scanning angle performance and side-lobe performance, and with the addition of edge sections, desired antenna characteristics may be achieved provided proper design of edge section.

According to some aspects, each edge section further comprises multiple edge dipoles 103, as disclosed in figured 10-12, and each edge dipole 103 comprises two edge elements 104 being mirror images of each other, i.e. symmetric dipoles. Furthermore, each edge dipole 103 has an edge dipole length LE, and each edge dipole 103 is configured to be arranged the same distance from the ground plane as the active dipoles. FIGS. 10-12 disclose single polarized radiators with asymmetric active dipoles 70 and multiple edge dipoles 103 in different configurations. The edge dipoles are configured to be arranged at a distance to the ground plane, and according to some aspects the distance between the edge dipoles and the ground plane is the same as for the active dipoles.

FIG. 10 is a single polarized radiator 100 operating within a frequency range with edge dipole unit cell of size λ/2, i.e. $L_E=\lambda/2$ based on the upper frequency of the frequency range. The polarized radiator comprises two edge sections 101 and 102, each comprising three edge dipoles 103. A first edge section 101 is capacitively coupled to the first side 75 of the multiple active dipoles 70 and a second edge section 102 is capacitively coupled to the second side 76 of the multiple active dipoles 70, the first side 75 is opposite to the second side 76.

In FIG. 10, the edge dipole length of each edge dipole 103 belonging to the same edge section is equal. The same applies for the single polarized radiator 110 in FIG. 11, in which the first edge section 111 and the second edge section 112 comprises six edge dipoles 103, each having an edge dipole length $L_E$ of λ/4. According to some aspects, the number of edge dipoles 103 within each edge section may be increased to twelve and the edge dipole length reduced to λ/8, not shown.

According to some aspects, the single polarized radiator 120 comprises a first edge section 121 and a second edge section 122, each having edge dipoles 103 where the edge dipole length of at least one edge dipole differs from an adjacent edge dipole belonging to the same edge section. In FIG. 12, each edge section comprises five edge dipoles 103 and the edge dipole length of adjacent edge dipoles is different. However, the edge sections are mirror images of each other.

Thus, antenna characteristics may be improved by adjusting the size of the edge dipole length, but also by applying different loading of each edge dipole belonging to the same edge section. Loading of the edge dipoles may be performed by connecting the feeding point of the edge dipoles to ground via an impedance and/or shorting the edge element to the ground.

Figure 13:
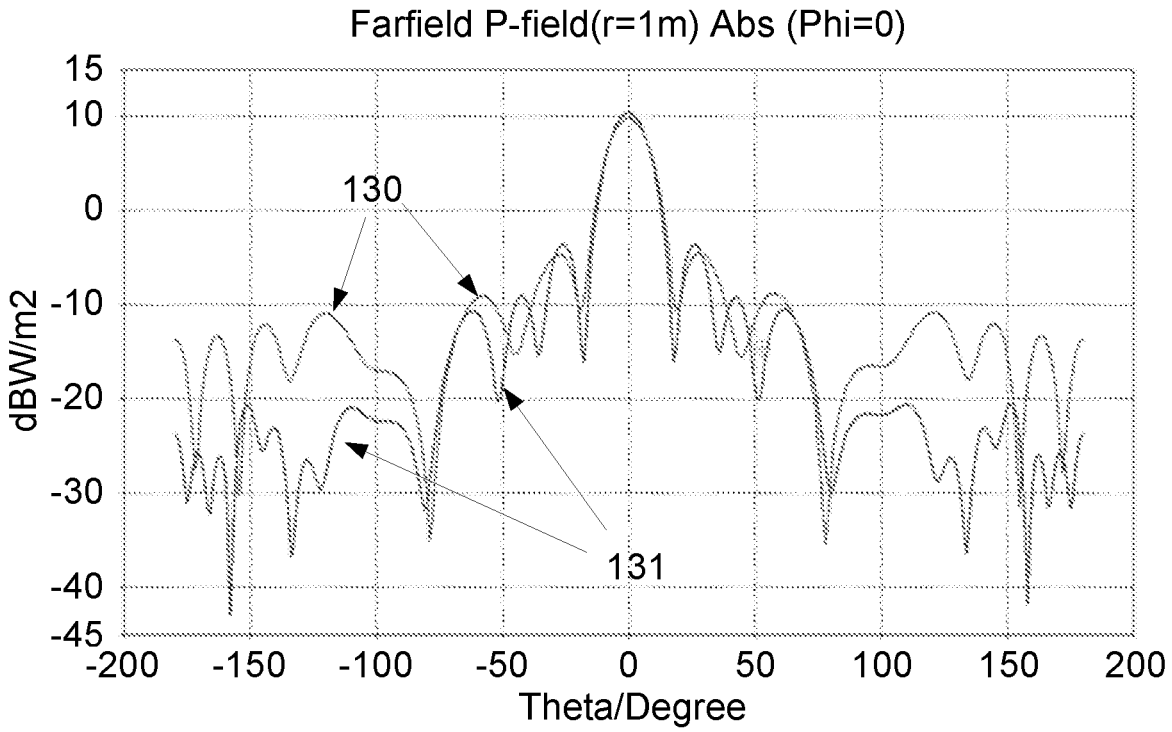
FIG. 13 is a graph illustrating the far field pattern at 3 GHz for a single polarized radiator with and without edge dipole elements.

FIG. 13 is a graph illustrating the far field pattern at 3 GHz for a single polarized radiator with and without edge dipole elements. Curve 130 illustrates the far field pattern for a single polarized radiator without edge dipoles and curve 131 illustrates the far field pattern for a single polarized radiator with six edge dipoles having an edge length of λ/4, as disclosed in connection with FIG. 11. The scanning angle performance and side-lobe performance for a single polarized radiator with edge dipoles is improved.

FIG. 16 is a first embodiment of a single polarized radiator 160 operating within a frequency range. The polarized radiator comprises four asymmetric active dipoles 70 and two edge sections 161 and 162, each comprising a meandering edge element 163. A first edge section 161 is capacitively coupled to the first side 75 of the multiple active dipoles 70 and a second edge section 162 is capacitively coupled to the second side 76 of the multiple active dipoles 70, the first side 75 is opposite to the second side 76.

Figure 17A:
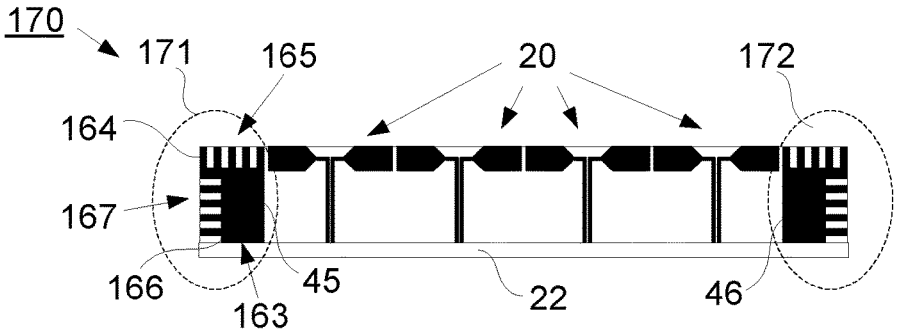
FIG. 17*a* is a second embodiment of a single polarized radiator with meandering edge elements.

FIG. 17*a* is a second embodiment of a single polarized radiator 170 operating within a frequency range. The polarized radiator comprises four symmetric active dipoles 20 and two edge sections 171 and 172, each comprising a meandering edge element 163. A first edge section 171 is capacitively coupled to the first side 45 of the multiple active dipoles 20 and a second edge section 172 is capacitively coupled to the second side 46 of the multiple active dipoles 20, the first side 45 is opposite to the second side 46.

The edge element 163 in FIGS. 16 and 17*a* has an edge profile 164 extending from a forward edge 165 adjacent to the first side 75 of the plurality of the active dipoles to a rear edge 166 connectable to the ground plane 22, and at least one meandering section is provided in the edge profile.

According to some aspects, a first 164 of the at least one meandering section is provided at the forward edge 165 of each edge element 163 and/or a second 166 of the at least one meandering section is provided at a side edge 167 of each edge element 163.

Figure 17B:
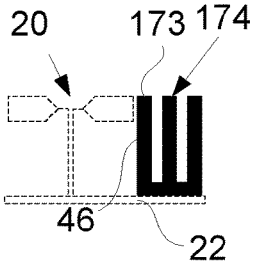
FIG. 17*b* is an alternative embodiment of an edge element.

FIG. 17*b* illustrate an alternative edge element 173 with a meandering section provided at a forward edge 174.

The meandering shape is sometimes referred to as soft surfaces configured to reduce the spatial harmonic frequencies generated at edge scattering.

Figure 14:
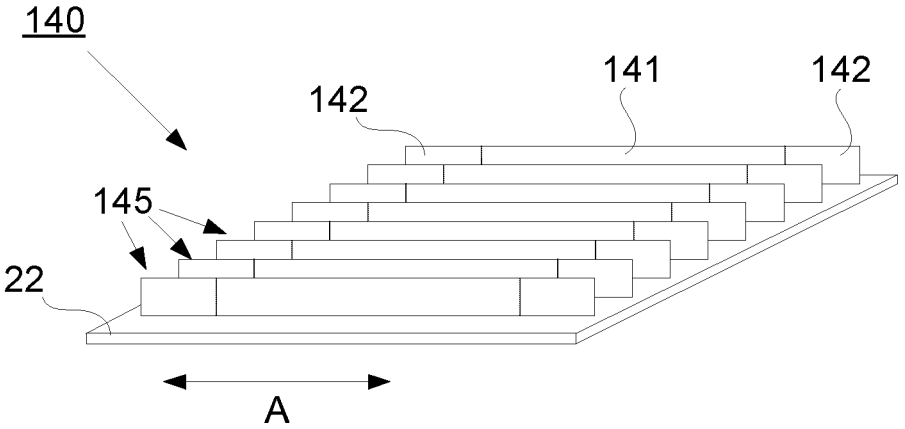
FIG. 14 is a wideband single polarized strongly coupled dipole element antenna array.

FIG. 14 is a single polarized strongly coupled dipole element broadband antenna 140 comprising in the example eight single polarized radiators 145 arranged in a first direction A parallel to each other on a ground plane 22. The single polarized radiators 145 are divided into active dipoles 141 and optionally edge sections 142. According to some aspects, the single polarized radiator 145 comprises asymmetric dipoles 70 (as disclosed in FIG. 7) as active dipoles 141. Optionally edge dipoles 103 (as disclosed in FIGS. 10-12) or edge elements 163 (as disclosed in FIG. 16) are provided as edge sections 142. According to some aspects, the single polarized radiator 145 comprises symmetric dipoles 20 (as disclosed in FIG. 2) as active dipoles 141 with edge dipoles 103 (as disclosed in FIGS. 10-12) or edge elements 163 (as disclosed in FIG. 16) provided as edge sections 142. WAIM may be provided as an optional feature (not shown).

FIG. 15 is a wideband dual polarized strongly coupled dipole element antenna 150 comprising multiple single polarized radiators 152, 153 arranged on a substrate 151 at a predetermined distance from a ground plane 22. At least a first 152 of the multiple single polarized radiator is arranged in a first direction A and at least a second 153 of the multiple single polarized radiator is arranged in a second direction B orthogonal to the first direction A.

According to some aspects, edge sections are implemented and the surface of the dual polarized antenna 150 is divided into an active area 154 and an edge area 155. Active dipoles (symmetric dipoles 20 or asymmetric dipoles 70 as disclosed in FIGS. 2 and 7, respectively) are arranged within the active area 154 and edge sections (edge dipoles 103 as disclosed in FIGS. 10-12 or edge elements 161 as disclosed in FIG. 16) are arranged within the edge area 155 surrounding the active area 154.

Figure 18A:
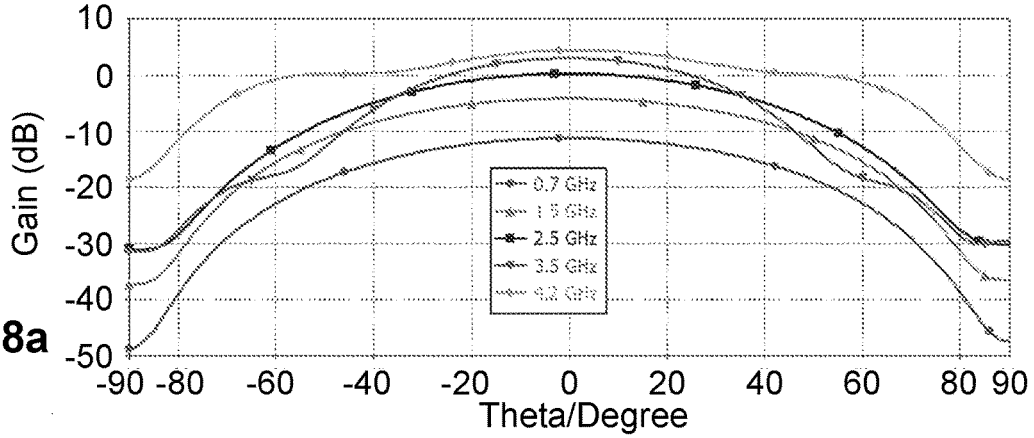
FIGS. 18*a* and 18*b* illustrate active element pattern for a unit cell of the single polarized radiator in FIG. 8.
Figure 18B:
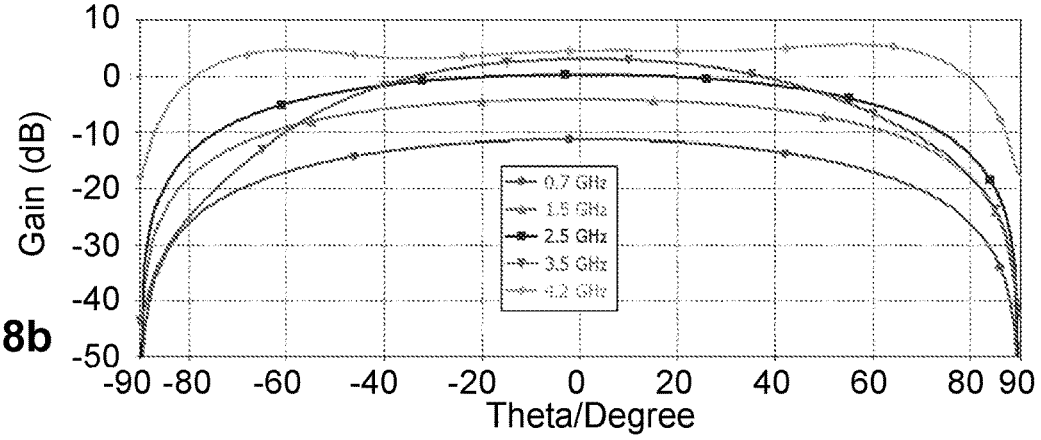

FIGS. 18*a* and 18*b* illustrate active element pattern for a unit cell 23 of the single polarized radiator 70 in FIG. 7 at different frequencies. FIG. 18*a* illustrates the E-plane and FIG. 18*b* illustrates the H-plane, which have similar behaviour and are fairly constant over the low and mid range of the frequency band.

Figure 19:
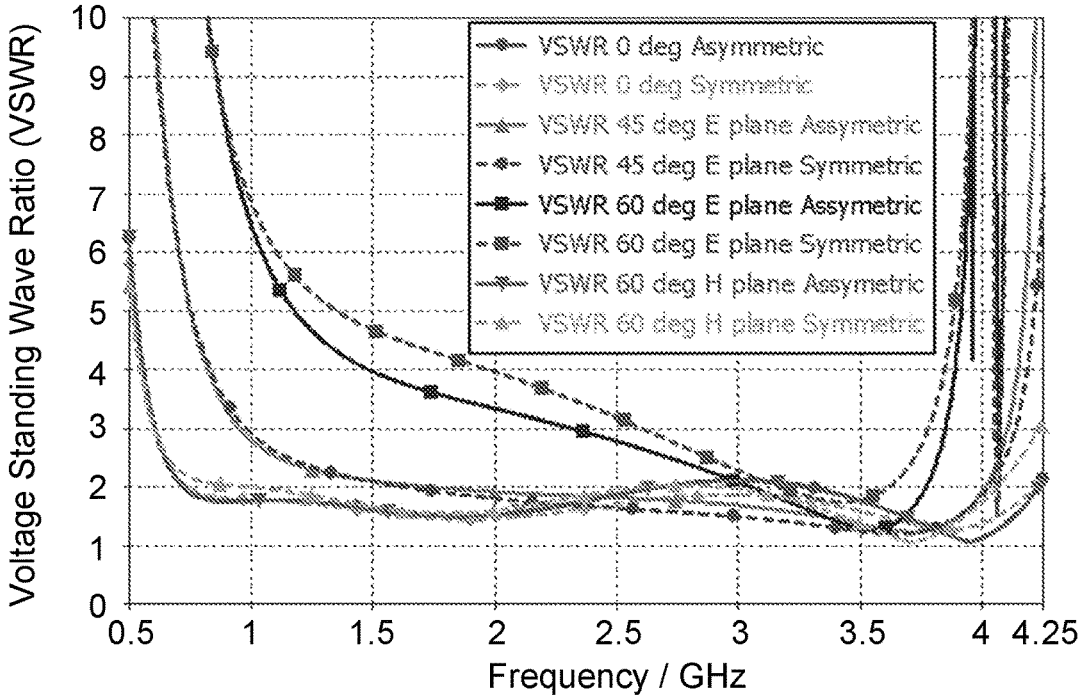
FIG. 19 is a graph illustrating VSWR for different scan angles of the symmetric and asymmetric unit cell.

FIG. 19 is a graph illustrating VSWR for different scan angles of the symmetric and asymmetric unit cell. It is observed that a 10% increase for VSWR=2 bandwidth at the 60 degree E-plane scan and 43% for the H-plane case for an asymmetric dipole compared to a symmetric dipole, as disclosed in FIG. 5.

It should be noted that the described embodiments gives the possibility to reduce the number of antennas at a mobile site from typical three antennas per sector down to one antenna due to increased frequency range. This is achieved by designing a broadband antenna based on strongly coupled dipoles with unique element design, different electrical characteristics of the active dipole elements and/or unique edge section design, such as different edge element sizes and loading. The described embodiments also have a much less complicated building practice compared to a traditional multiband antenna since no cabling is required like in a traditional dipole antenna. Phase shifters to achieve tilt are also not required since tilt per band is achieved in the radio or in the baseband instead of in the antenna. The proposed solution is more compact than the Vivaldi based wideband solution.

In the drawings and specification, there have been disclosed exemplary aspects of the disclosure. However, many variations and modifications can be made to these aspects without substantially departing from the principles of the present disclosure. Thus, the disclosure should be regarded as illustrative rather than restrictive, and not as being limited to the particular aspects discussed above. Accordingly, although specific terms are employed, they are used in a generic and descriptive sense only and not for purposes of limitation.

The description of the example embodiments provided herein have been presented for purposes of illustration. The description is not intended to be exhaustive or to limit example embodiments to the precise form disclosed, and modifications and variations are possible in light of the above teachings or may be acquired from practice of various alternatives to the provided embodiments. The examples discussed herein were chosen and described in order to explain the principles and the nature of various example embodiments and its practical application to enable one skilled in the art to utilize the example embodiments in various manners and with various modifications as are suited to the particular use contemplated. The features of the embodiments described herein may be combined in all possible combinations of methods, apparatus, modules, systems, and computer program products. It should be appreciated that the example embodiments presented herein may be practiced in any combination with each other.

It should be noted that the word "comprising" does not necessarily exclude the presence of other elements or steps than those listed and the words "a" or "an" preceding an element do not exclude the presence of a plurality of such elements. It should further be noted that any reference signs do not limit the scope of the claims, that the example embodiments may be implemented at least in part by means of both hardware and software, and that several "means", "units" or "devices" may be represented by the same item of hardware.

A "wireless device" as the term may be used herein, is to be broadly interpreted to include a radiotelephone having ability for Internet/intranet access, web browser, organizer, calendar, a camera (e.g., video and/or still image camera), a sound recorder (e.g., a microphone), and/or global positioning system (GPS) receiver; a personal communications system (PCS) user equipment that may combine a cellular radiotelephone with data processing; a personal digital assistant (PDA) that can include a radiotelephone or wireless communication system; a laptop; a camera (e.g., video and/or still image camera) having communication ability; and any other computation or communication device capable of transceiving, such as a personal computer, a home entertainment system, a television, etc. Furthermore, a device may be interpreted as any number of antennas or antenna elements.

Although the description is mainly given for a user equipment, as measuring or recording unit, it should be understood by the skilled in the art that "user equipment" is a non-limiting term which means any wireless device, terminal, or node capable of receiving in DL and transmitting in UL (e.g. PDA, laptop, mobile, sensor, fixed relay, mobile relay or even a radio base station, e.g. femto base station).

A cell is associated with a radio node, where a radio node or radio network node or eNodeB used interchangeably in the example embodiment description, comprises in a general sense any node transmitting radio signals used for measurements, e.g., eNodeB, macro/micro/pico base station, home eNodeB, relay, beacon device, or repeater. A radio node herein may comprise a radio node operating in one or more frequencies or frequency bands. It may be a radio node capable of CA. It may also be a single- or multi-RAT node. A multi-RAT node may comprise a node with co-located RATs or supporting multi-standard radio (MSR) or a mixed radio node.

The various example embodiments described herein are described in the general context of method steps or processes, which may be implemented in one aspect by a computer program product, embodied in a computer-readable medium, including computer-executable instructions, such as program code, executed by computers in networked environments. A computer-readable medium may include removable and non-removable storage devices including, but not limited to, Read Only Memory (ROM), Random Access Memory (RAM), compact discs (CDs), digital versatile discs (DVD), etc. Generally, program modules may include routines, programs, objects, components, data structures, etc. that perform particular tasks or implement particular abstract data types. Computer-executable instructions, associated data structures, and program modules represent examples of program code for executing steps of the methods disclosed herein. The particular sequence of such executable instructions or associated data structures represents examples of corresponding acts for implementing the functions described in such steps or processes.

In the drawings and specification, there have been disclosed exemplary embodiments. However, many variations and modifications can be made to these embodiments. Accordingly, although specific terms are employed, they are used in a generic and descriptive sense only and not for purposes of limitation, the scope of the embodiments being defined by the following claims.

The invention claimed is:

1. A single polarized radiator for operating within a frequency range, the single polarized radiator comprising:

multiple active dipoles configured to be a predetermined distance from a ground plane, each active dipole comprising a first active element having first electrical characteristics and a second active element having second electrical characteristics, which first and second active elements are equal in length and provided with a respective feeding point, wherein:

in each active dipole, the first electrical characteristics differs from the second electrical characteristics, a length of each active element is selected based on an upper frequency of the frequency range, one or both of the first active element and the second active element of each active dipole capacitively coupled to an active element of an adjacent active dipole; and a first edge section and a second edge section, the first edge section capacitively coupled to a first side of the multiple active dipoles and the second edge section capacitively coupled to a second side of the multiple active dipoles, the second side opposite to the first side, wherein the first and second edge sections are configured to reduce edge propagating waves, and each edge section comprises an edge element having an edge profile extending from a forward edge, adjacent to a respective side, to a rear edge connected to the ground plane, and at least one meandering section provided in the edge profile.

2. The single polarized radiator according to claim 1, wherein the predetermined distance between the active dipoles and the ground plane is selected based on the upper frequency.

3. The single polarized radiator according to claim 2, wherein the predetermined distance is within the range of 0.25 to 0.5 of a wavelength of the upper frequency.

4. The single polarized radiator according to claim 3, wherein the predetermined distance is the wavelength of the upper frequency divided by 2.3.

5. The single polarized radiator according to claim 1, wherein electrical characteristics of the multiple active dipoles are the same.

6. The single polarized radiator according to claim 1, wherein electrical characteristics of at least one of the multiple active dipoles are unique.

7. The single polarized radiator according to claim 1, wherein electrical characteristics of each of the multiple active dipoles are unique.

8. The single polarized radiator according to claim 1, wherein each edge section further comprising:

multiple edge dipoles, each edge dipole comprising two edge elements being mirror images of each other, each edge dipole having an edge dipole length, and each edge dipole configured to be a same distance from the ground plane as the active dipoles.

9. The single polarized radiator according to claim 8, wherein the edge dipole length of each edge dipole belonging to the same edge section is equal.

10. The single polarized radiator according to claim 8, wherein the edge dipole length of at least one edge dipole differs from an adjacent edge dipole belonging to the same edge section.

11. The single polarized radiator according to claim 8, wherein different loading is applied to the edge dipoles belonging to the same edge section.

12. The single polarized radiator according to claim 1, wherein a first meandering section is provided at the forward edge of each edge element, or a second meandering section is provided at a side edge of each edge element, or both the first and second meandering sections are provided.

13. A single polarized radiator operating within a frequency range, the single polarized radiator comprising:

multiple active dipoles configured to be a predetermined distance from a ground plane, each active dipole comprising a first active element having first electrical characteristics and a second active element having second electrical characteristics, which first and second active elements are equal in length and provided with a respective feeding point, a length of each active element selected based on an upper frequency of the frequency range, and one or both of the first active element and the second active element of each active dipole capacitively coupled to an active element of an adjacent active dipole; and a first edge section and a second edge section, the first edge section capacitively coupled to a first side of the multiple active dipoles and the second edge section capacitively coupled to a second side of the multiple active dipoles, the second side opposite to the first side, wherein the edge sections are configured to reduce edge propagating waves, and each edge section comprises an edge element having an edge profile extending from a forward edge, adjacent to a respective side, to a rear edge connected to the ground plane, and at least one meandering section provided in the edge profile.

14. The single polarized radiator according to claim 13, wherein each edge section further comprising:

multiple edge dipoles, each edge dipole comprising two edge elements being mirror images of each other, each edge dipole having an edge dipole length, and each edge dipole is configured to be a same distance from the ground plane as the active dipoles.

15. The single polarized radiator according to claim 14, wherein the edge dipole length of each edge dipoles belonging to the same edge section is equal.

16. The single polarized radiator according to claim 14, wherein the edge dipole length of at least one edge dipole differs from an adjacent edge dipole belonging to the same edge section.

17. The single polarized radiator according to claim 14, wherein different loading is applied to the edge dipoles belonging to the same edge section.

18. The single polarized radiator according to claim 13, wherein a first meandering section is provided at the forward edge of each edge element, or a second meandering section is provided at a side edge of each edge element, or both the first and second meandering sections are provided.

19. The single polarized radiator according to claim 13, wherein in each active dipole, the first electrical characteristics differs from the second electrical characteristics.

20. The single polarized radiator according to claim 19, wherein the predetermined distance between the active dipoles and the ground plane is selected based on the upper frequency.

21. A single polarized broadband antenna having at least one single polarized radiator, the single polarized radiator for operating within a frequency range comprising:

multiple active dipoles configured to be a predetermined distance from a ground plane, each active dipole comprising a first active element having first electrical characteristics and a second active element having second electrical characteristics, which first and second active elements are equal in length and provided with a respective feeding point, wherein:

in each active dipole, the first electrical characteristics differs from the second electrical characteristics, the length of each active element is selected based on an upper frequency of the frequency range, one or both of the first active element and the second active element of each active dipole capacitively coupled to an active element of an adjacent active dipole; and a first edge section and a second edge section, the first edge section capacitively coupled to a first side of the multiple active dipoles and the second edge section capacitively coupled to a second side of the multiple active dipoles, the second side opposite to the first side, wherein the first and second edge sections are configured to reduce edge propagating waves, and each edge section comprises an edge element having an edge profile extending from a forward edge, adjacent to a respective side, to a rear edge connected to the ground plane, and at least one meandering section provided in the edge profile.

22. A dual polarized broadband antenna having multiple single polarized radiators, wherein at least one single polarized radiator for operating within a frequency range comprising:

multiple active dipoles configured to be a predetermined distance from a ground plane, each active dipole comprising a first active element having first electrical characteristics and a second active element having second electrical characteristics, which first and second active elements are equal in length and provided with a respective feeding point, wherein:

in each active dipole, the first electrical characteristics differs from the second electrical characteristics, the length of each active element is selected based on an upper frequency of the frequency range, one or both of the first active element and the second active element of each active dipole capacitively coupled to an active element of an adjacent active dipole; and a first edge section and a second edge section, the first edge section capacitively coupled to a first side of the multiple active dipoles and the second edge section capacitively coupled to a second side of the multiple active dipoles, the second side opposite to the first side, wherein the first and second edge sections are configured to reduce edge propagating waves, and each edge section comprises an edge element having an edge profile extending from a forward edge, adjacent to a respective side, to a rear edge connected to the ground plane, and at least one meandering section provided in the edge profile.

* * * * *